US009501028B2

(12) United States Patent
Hayayumi

(10) Patent No.: US 9,501,028 B2
(45) Date of Patent: Nov. 22, 2016

(54) UNIT MOVING APPARATUS AND IMAGE FORMING APPARATUS

(71) Applicant: CANON KABUSHIKI KAISHA, Tokyo (JP)

(72) Inventor: Fumihiko Hayayumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/008,857

(22) Filed: Jan. 28, 2016

(65) Prior Publication Data

US 2016/0231692 A1 Aug. 11, 2016

(30) Foreign Application Priority Data

Jan. 30, 2015 (JP) ..... 2015-017857

(51) Int. Cl.
*G03G 15/00* (2006.01)
*G03G 21/16* (2006.01)

(52) U.S. Cl.
CPC ..... *G03G 21/1638* (2013.01); *G03G 15/6502* (2013.01)

(58) Field of Classification Search
CPC ..... G03G 15/6502; G03G 21/1638
USPC ..... 399/124, 391, 393
See application file for complete search history.

(56) References Cited

U.S. PATENT DOCUMENTS

2006/0140695 A1* 6/2006 Yonemoto ..... B41J 13/103 399/393
2015/0023710 A1* 1/2015 Yuasa ..... G03G 15/6502 399/393

FOREIGN PATENT DOCUMENTS

JP 2011037629 A 2/2011
JP 2012101888 A 5/2012

* cited by examiner

*Primary Examiner* — Hoang Ngo
(74) *Attorney, Agent, or Firm* — Canon U.S.A. Inc., IP Division

(57) ABSTRACT

A unit moving apparatus includes a unit provided to a main body in such a manner so as to be attached to and pulled out from the main body, a main-body guide portion provided to the main body and configured to guide the unit while restricting rotation of the unit at a time of attaching and pulling out the unit, a pull-in unit configured to apply a pulling force to the unit to pull the unit into the main body, and a unit restriction portion configured to restrict rotation of the unit in such a manner that the units rotates within an angle smaller than an angle to which the main-body guide portion restricts the unit's rotation when a rotation moment is generated by the pulling force of the pull-in unit applied to the unit and a load applied to the unit in a direction opposite to an attachment direction.

16 Claims, 14 Drawing Sheets

UNIT MOVING APPARATUS AND IMAGE FORMING APPARATUS

BACKGROUND OF THE INVENTION

Field of the Invention

The present invention relates to a unit moving apparatus that moves a unit with respect to a main body and an image forming apparatus including the unit moving apparatus.

Description of the Related Art

Conventionally, an image forming apparatus such as a printer, and a copying machine is provided with a unit that can be slid and pulled out from a main body of the image forming apparatus for sheet replenishment, removal of a sheet jammed in transportation, or various types of maintenance. After the unit is slid and pulled out, the unit is re-attached to the original position. At this time, a load is applied between the pulled unit and the main body from various units, such as a contact release unit of each component, and positioning unit, when the unit is moved in an attachment direction.

In many cases, since the attachment of the unit is manually conducted by the user, insufficient attachment may occur because of the load, and the insufficient attachment of the unit can give rise to image quality degradation. Furthermore, operability at the time of the attachment of the unit is degraded.

In view of the foregoing situation, some conventional apparatuses are equipped with a unit pull-in mechanism assisting in the attachment of the unit to improve the unit attachment reliability and reduce operational force (refer to Japanese Patent Application Laid-Open No. 2012-101888). The unit pull-in mechanism requires sufficient pulling force to automatically and surely pull in the unit to the attachment completion position against the load applied to the unit during the attachment.

The load applied to a sheet feeding cassette during the attachment of the sheet feeding cassette to a main body will be described below. The sheet feeding cassette is an example of a unit to which a load is applied when the unit is pulled in. The sheet feeding cassette stores sheets therein and is provided so as to be attachable to and detachable from the main body of the image forming apparatus. A positioning unit is provided between the sheet feeding cassette and the main body because the sheet feeding cassette needs to be attached to an appropriate position in the main body of the image forming apparatus. For example, in general, the positioning unit is configured to perform the positioning by fitting a fitting boss into a fitting hole. In such a configuration, resistance generated when the fitting boss is fitted into the fitting hole becomes the load applied when the sheet feeding cassette is pulled in.

Further, in a case where a sheet stacking portion that is provided to the sheet feeding cassette and on which sheets are stacked is lifted by driving of a motor provided to the main body of the image forming apparatus, the driving of the motor needs to be transmitted to a lifter tray provided on a lower side of the sheet stacking unit. In this case, a driving gear of the main body is meshed with a driven gear connected to the lifter tray while the sheet feeding cassette is being pulled in. Accordingly, when the gears are meshed together, a load is applied to the sheet feeding cassette.

Furthermore, the sheet feeding cassette receives loads from various other units besides the foregoing units when the sheet feeding cassette is pulled in. In many cases, such e units that generate the loads are arranged not evenly but unevenly due to the positional relationship between the main body of the image forming apparatus and the unit.

If the load that is applied when the sheet feeding cassette is pulled in is not even, a rotation moment occurs in the sheet feeding cassette, the sheet feeding cassette is inclined, and the sheet feeding cassette being inclined is pulled in. As a result, the load further increases, so the pulling force of the unit pull-in mechanism needs to be set large. However, when the pulling force of the unit pull-in mechanism is set large, a large force is required to pull out the sheet feeding cassette from the attachment completion position, so that operability is degraded.

In response to the foregoing problem, a technique has been discussed in which two points of action, at which a large resistance force mainly becoming the load is strongly applied are located, and the position of a unit pull-in mechanism is specified with respect to the points of action, so that the generation of a rotation moment is minimized (refer to Japanese Patent Application Laid-Open No. 2011-37629).

However, in a case where there is a plurality of units that generate loads when the unit is pulled in, it is sometimes difficult to realize an optimum arrangement as discussed in Japanese Patent Application Laid-Open No. 2011-37629. Further, in a case of a compact product, units that generate a resistance load are often disposed unevenly with respect to the main body of an apparatus. In such a case, it is sometimes impossible to dispose the unit pull-in mechanism in the vicinity of the units. Consequently, an increase in a load associated with generation of a rotation moment has been difficult to avoid with devising the disposition.

Furthermore, due to operational constraints of the units, the loads are often generated at different time points during the attachment of the unit. In such a case, there exist limitations in preventing generation of a rotation moment merely by devising the disposition.

SUMMARY OF THE INVENTION

The present invention is directed to a unit moving apparatus that provides high attachment reliability without degrading user operability, and an image forming apparatus including the unit moving apparatus.

According to an aspect of the present invention, a unit moving apparatus includes a unit provided to a main body in such a manner so as to be attached to and pulled out from the main body, a main-body guide portion provided to the main body and configured to guide the unit while restricting rotation of the unit at a time of attaching and pulling out the unit, a pull-in unit configured to apply a pulling force to the unit to pull the unit into the main body, and a unit restriction portion configured to restrict rotation of the unit in such a manner that the units rotates within an angle smaller than an angle to which the main-body guide portion restricts the unit's rotation when a rotation moment is generated by the pulling force of the pull-in unit applied to the unit and a load applied to the unit in a direction opposite to an attachment direction.

Further features of the present invention will become apparent from the following description of exemplary embodiments with reference to the attached drawings.

DESCRIPTION OF THE EMBODIMENTS

A unit moving apparatus according to exemplary embodiments of the present invention and an image forming apparatus provided with the unit moving apparatus will be described with reference to the drawings. A sheet feeding cassette will be described as an example of the unit.

Figure 1:
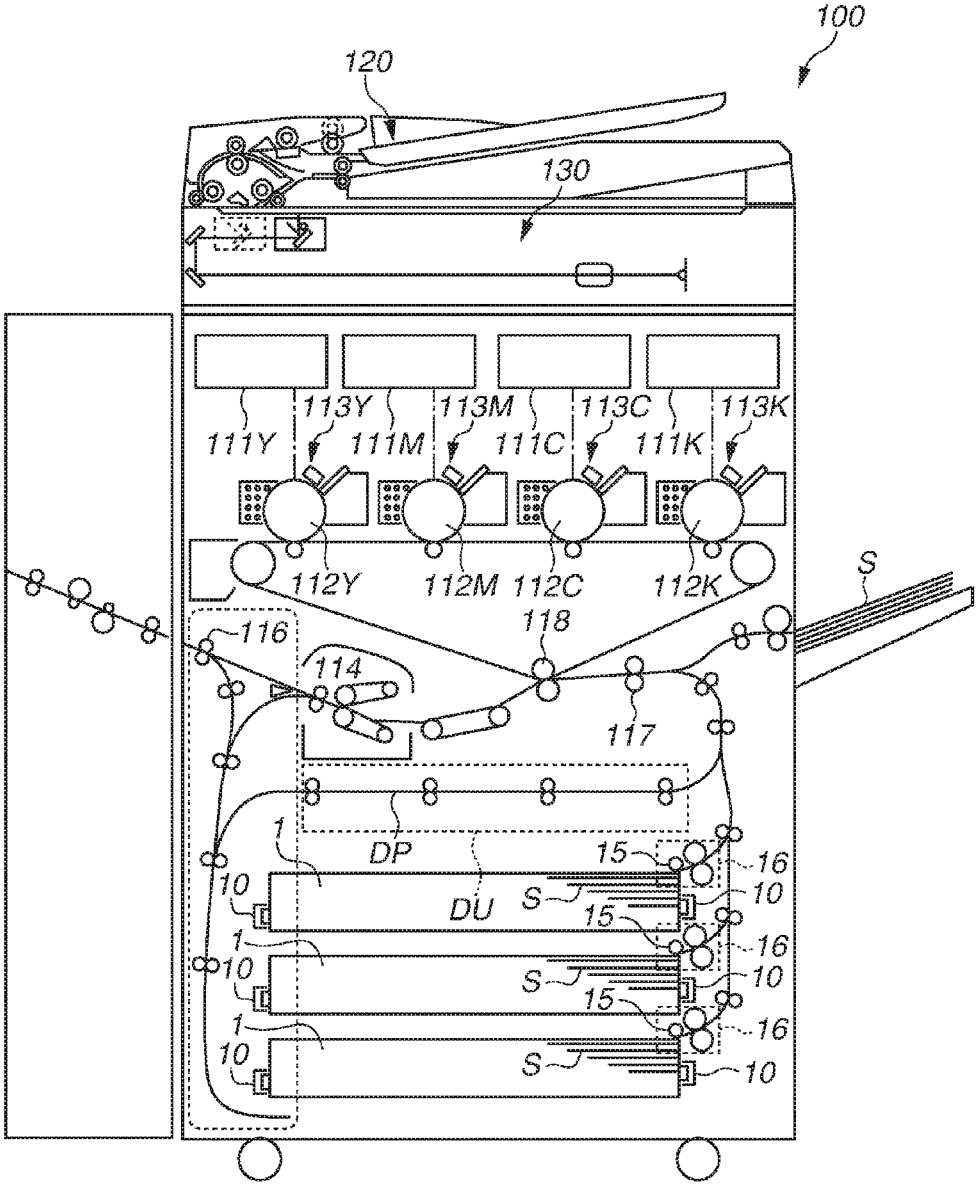
FIG. 1 is a schematic cross-sectional view illustrating an image forming apparatus provided with a unit moving apparatus.
Figure 2A:
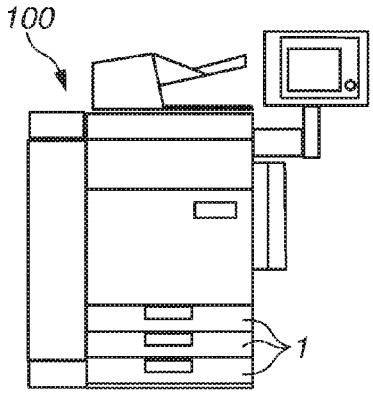
FIG. 2A is a front view illustrating the image forming apparatus provided with the unit moving apparatus.
Figure 2B:
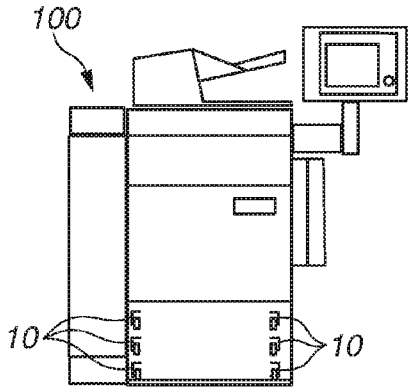
FIGS. 2B and 2C are perspective views each illustrating the image forming apparatus with sheet feeding cassettes being pulled out.
Figure 2C:
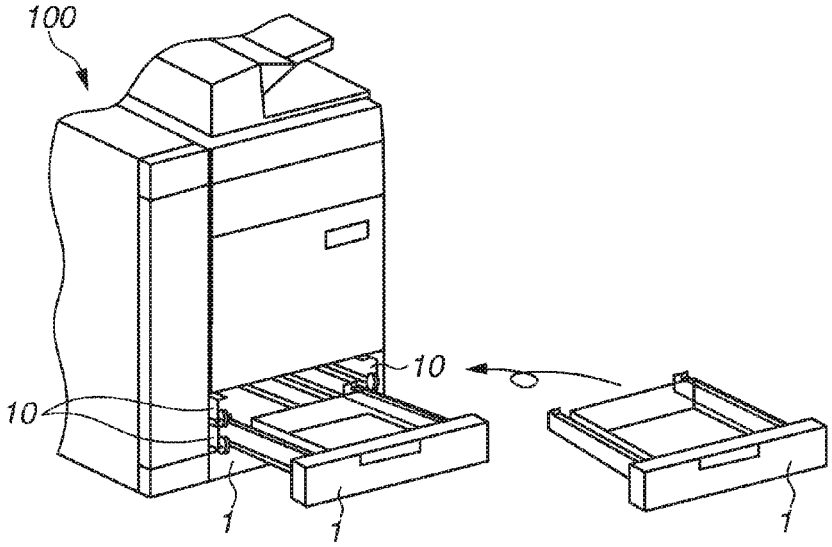

FIG. 1 is a schematic cross-sectional view illustrating an image forming apparatus 100 provided with a unit moving apparatus according to an exemplary embodiment of the present invention. FIG. 2A is a front view illustrating the image forming apparatus 100 provided with the unit moving apparatus according to the present exemplary embodiment. FIG. 2B illustrates the state in which sheet feeding cassettes are removed from the image forming apparatus. FIG. 2C illustrates the state in which the sheet feeding cassettes are pulled out. FIG. 2A is a view illustrating a front face of the image forming apparatus 100, and the user operates the image forming apparatus 100 from the front face.

As illustrated in FIG. 1, an automatic document feeding apparatus 120 and an image reading unit 130 are provided to an upper part of the image forming apparatus 100. The automatic document feeding apparatus 120 automatically feeds documents, and the image reading unit 130 reads images of the documents. Information about the images of the documents read by the image reading unit 130 or image information transmitted from a personal computer (not illustrated), etc. via an external connection cable is processed by a controller (not illustrated).

Further, laser light beams are emitted from laser scanner units 111 of different colors according to signals based on the processing result to form electrostatic latent images on photosensitive drums 112, and the electrostatic latent images on the photosensitive drums 112 are developed by development units 113. Toner images formed on the surface of the photosensitive drums 112 are primarily transferred onto the surface of a secondary transfer belt sequentially to form a color toner image.

Meanwhile, a sheet such as paper and an overhead transparency (OHT) stored in sheet feeding cassettes 1 is picked up by a pickup roller 15 of a sheet feeding unit 16 and is conveyed to a registration unit 117. The sheet is sent from the registration unit 117 in synchronization with the toner image on the secondary transfer belt, and the toner image is transferred onto the sheet at a transfer unit 118. Further, the sheet on which the toner image is transferred is guided to a fixing roller pair 114 and undergoes heating and pressing processing, so that the toner image is fixed onto the sheet.

As illustrated in FIGS. 2A and 2B, the sheet feeding cassettes 1 (hereinafter, correctively referred to as a "sheet feeding cassette 1") are provided so as to be pulled frontward (direction perpendicular to the plane of the paper (FIG. 2*a* or 2B)) of a main body of the image forming apparatus 100 along guide rails 10 (hereinafter, correctively referred to as a "guide rail 10") provided to the main body of the image forming apparatus 100, and sheets on which images are to be formed, such as paper and OHT can be set into the sheet feeding cassette 1 by the user.

Before description of the unit moving apparatus according to the present exemplary embodiment, a problem to be solved by the unit moving apparatus according to the present exemplary embodiment will be described below using the sheet feeding cassette 1 as an example.

Figure 10C:
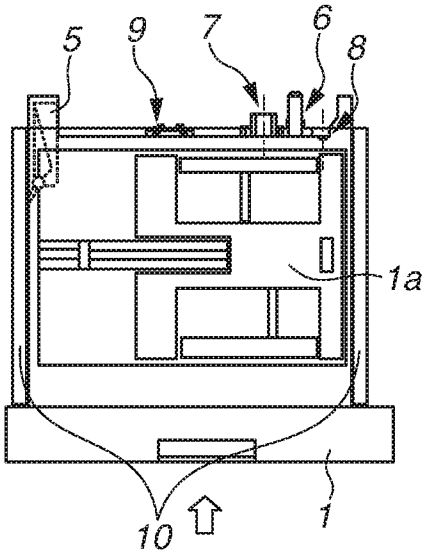
FIGS. 10A, 10B, and 10C are top views each illustrating an operation to pull a sheet feeding cassette into a main body of an apparatus to attach the sheet feeding cassette 1.
Figure 10B:
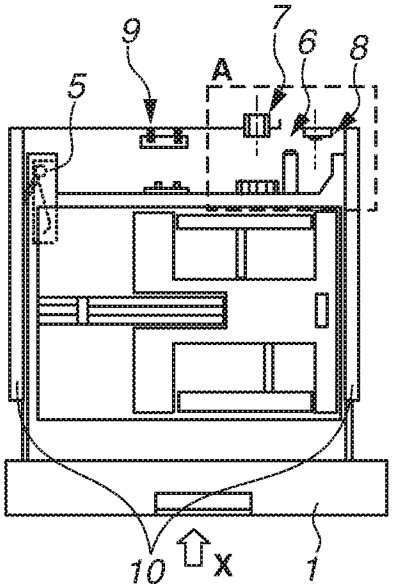
Figure 10A:
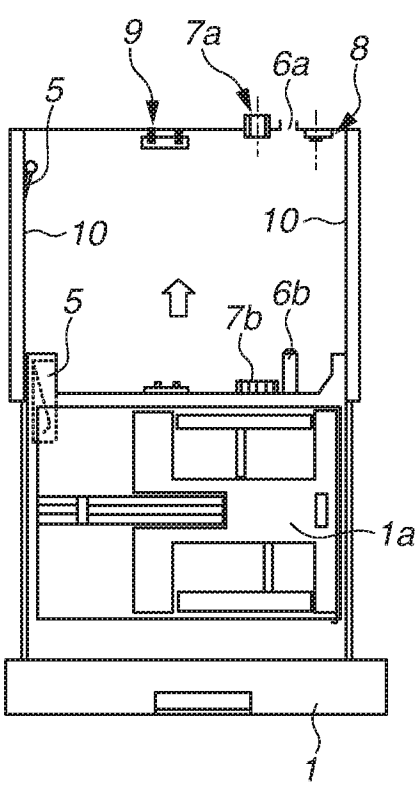
Figure 11:
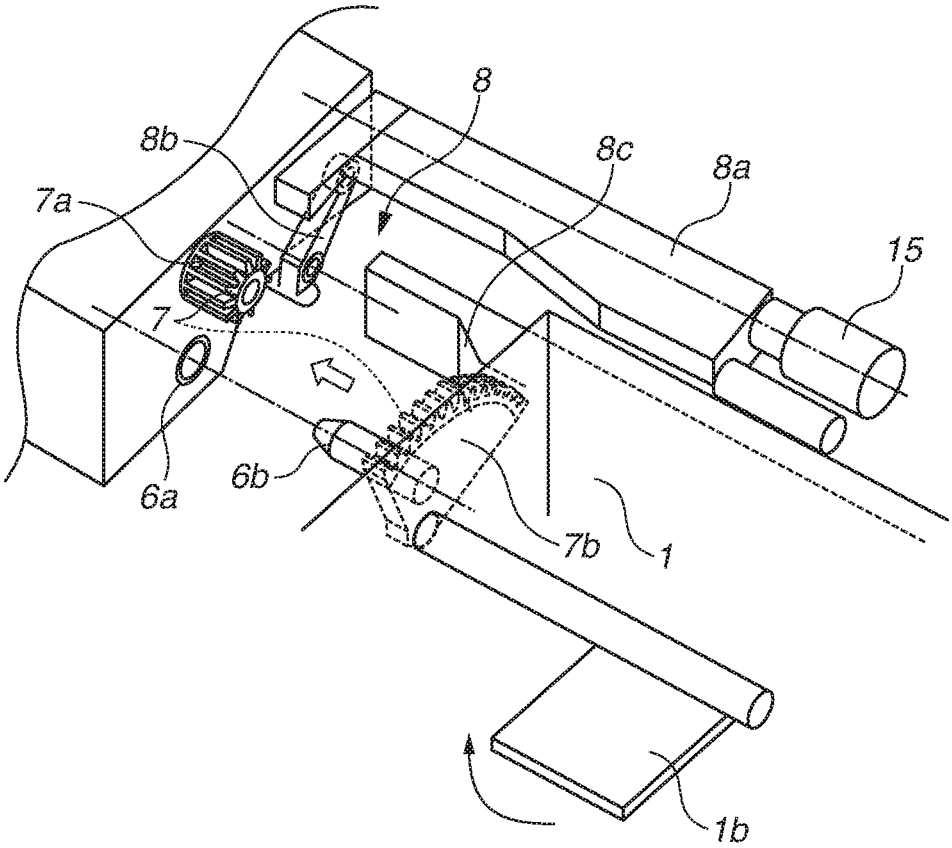
FIG. 11 is an enlarged perspective view illustrating units generating a resistance load.
Figure 12A:
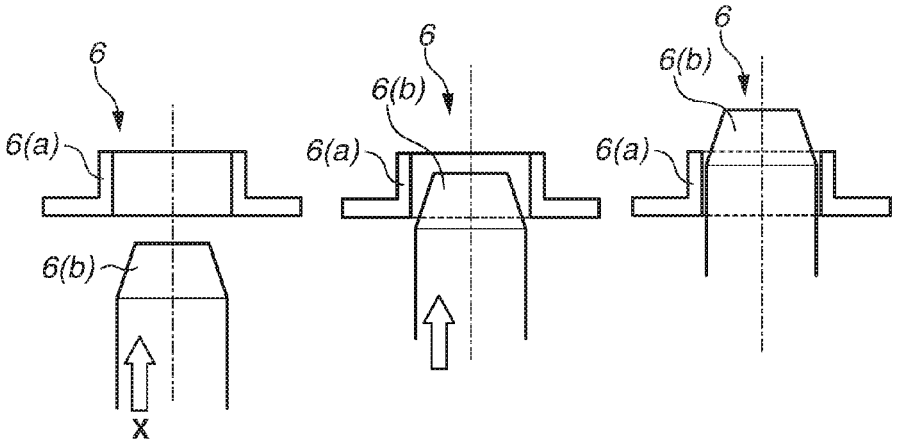
FIGS. 12A, 12B, and 12C are explanatory views each illustrating an operation of a unit generating a resistance load.
Figure 12B:
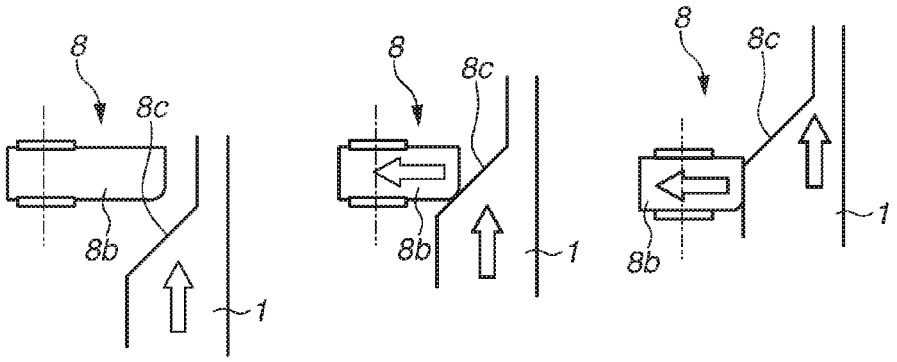
Figure 12C:
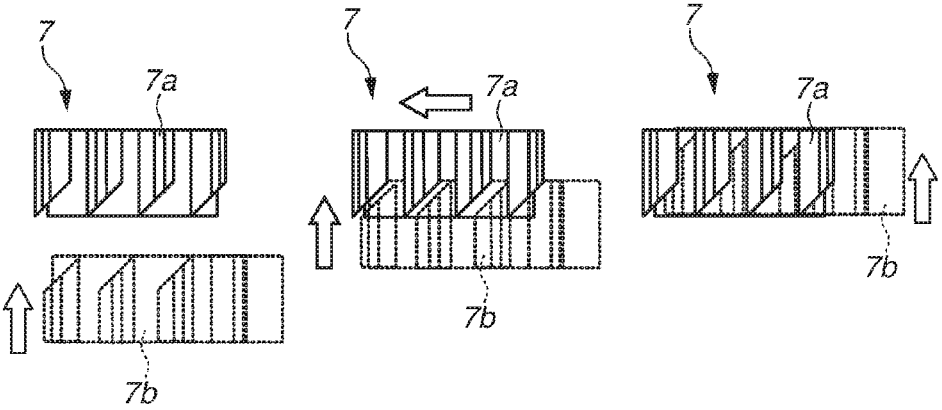

FIGS. 10A, 10B, and 10C are top views each illustrating an operation to pull the sheet feeding cassette 1 into the main body of the image forming apparatus 100 to attach the sheet feeding cassette 1. FIG. 10A illustrates the state in which the sheet feeding cassette 1 is pulled out from the main body of the image forming apparatus 100. FIG. 10B illustrates the state in which the sheet feeding cassette 1 is being attached into the main body of the image forming apparatus 100. FIG. 10C illustrates the state in which the sheet feeding cassette 1 is completely attached. FIG. 11 is an enlarged perspective view illustrating a portion A specified in FIG. 10B. FIGS. 12A, 12B, and 12C illustrate the states in which loads are applied from each unit described below.

A unit pull-in mechanism 5 is arranged to automatically pull in the sheet feeding cassette 1 being attached from a predetermined position. The unit pull-in mechanism 5 may be any configuration that forcibly pulls the sheet feeding cassette 1 by use of an elastic force of a spring, etc. when the sheet feeding cassette 1 is attached to a predetermined position in the main body of the image forming apparatus 100 by the user. Such a configuration includes a toggle method and a method in which an elastic force of a spring is accumulated.

A positioning unit 6 (6*a* and 6*b*), a driving transmission unit 7, and a separating unit 8 illustrated in FIG. 11 are examples of configurations, generating the load, located between the sheet feeding cassette 1 and the main body of the image forming apparatus 100.

The positioning unit 6 positions the sheet feeding cassette 1 in the main body of the image forming apparatus 100. A fitting boss 6*b* provided to the sheet feeding cassette 1 is fitted into a fitting hole 6*a* formed in the main body of the image forming apparatus 100 to position the sheet feeding cassette 1 within the main body of the image forming apparatus 100. In the positioning unit 6, sliding resistance (refer to FIG. 12A) generated when the fitting boss 6*b* is fitted into the fitting hole 6*a* becomes the load applied at the time of the attachment of the sheet feeding cassette 1.

The driving transmission unit 7 includes a driving gear 7*a* and a driven gear 7*b*, which transmit a driving force for lifting up and down a sheet tray 1*a* (refer to FIG. 10A) on which sheets are stacked. The sheet tray 1*a* on which sheets are stacked is provided to the sheet feeding cassette 1 so as to swing vertically and is lifted up by a driving force of a motor, etc. The driving force of a motor, etc. is transmitted to a lifter unit 1*b* of the sheet feeding cassette 1 while the driving gear 7*a* and the driven gear 7*b* are meshed together, and the lifter unit 1*b* is rotated to lift up the sheet tray 1*a*. In this way, the sheets stacked on the sheet tray 1*a* are lifted up so that the sheets can be ready to be fed by the pickup roller 15. When the driven gear 7*b* abuts against the driving gear 7*a* and one of the driving gear 7*a* and the driven gear 7*b* is rotated so that phases match at the time of the attachment of the sheet feeding cassette 1 (refer to FIG. 12C), the load applied at the time of the attachment of the sheet feeding cassette 1 occurs.

The separation unit 8 including 8*a* and 8*b* separates the pickup roller 15 from the sheets stored in the sheet feeding cassette 1 at the time when the sheet feeding cassette 1 is pulled out from and attached into the main body of the image forming apparatus 100. A holder 8*a* configured to support the pickup roller 15 is swingably supported on the main body of the image forming apparatus 100 by an interlocking member 8*b* configured to lift up the holder 8*a* is provided to the main body of the image forming apparatus 100. The interlocking member 8*b* is held by a spring (not illustrated) at a position to lift up the holder 8*a*. Then, at the time of the attachment of the sheet feeding cassette 1, a slope 8*c* of the sheet feeding cassette 1 rotates the interlocking member 8*b* against the elastic force of the spring to release the holder 8*a* from the lifted state, and moves down the pickup roller 15 to a position from which sheets can be fed. The resistance generated when the interlocking member 8*b* is rotated during the attachment of the sheet feeding cassette 1 (refer to FIG. 12B) becomes the load applied at the time of the attachment of the sheet feeding cassette 1.

A detection unit 9 is disposed at a position of the main body of the image forming apparatus 10 corresponding to a central part of the sheet feeding cassette 1. The detection unit 9 includes a sensor switch for detecting the size of a sheet to be stored, as illustrated in FIGS. 10A, 10B, and 10C. The sensor switch of the detection unit is supported in a floating state by a spring, etc., and when the sheet feeding cassette 1 is attached, the sensor switch is thrust back against the urging force of the spring and positioned in a normal position at which the sheet sizes are detectable. The urging force of the spring becomes the load applied at the time of the attachment of the sheet feeding cassette 1. The units 6, 7, 8, and 9 apply loads to the sheet feeding cassette 1 in a direction opposite to an attachment direction X of the sheet feeding cassette 1 (hereinafter, also simply referred to as an "attachment direction X") at the time of the attachment of the sheet feeding cassette 1.

As in the examples illustrated in FIGS. 10A, 10B, and 10C, the units 6, 7, 8, and 9, which generate loads, are often unevenly located on one side of the sheet feeding cassette 1 to be moved because of the disposition with respect to related units. On the other hand, the unit pull-in mechanism 5 is disposed in an area distant from the units 6, 7, 8, and 9, which generate loads, because the unit pull-in mechanism 5 needs to be located in a position where the unit pull-in mechanism 5 does not interfere with the units 6, 7, 8, and 9 when pulling in the sheet feeding cassette 1. In the present exemplary embodiment, the unit pull-in mechanism 5 is disposed on the back side of an attachment part of the sheet feeding cassette 1 and on the left side in FIG. 10.

Figure 14A:
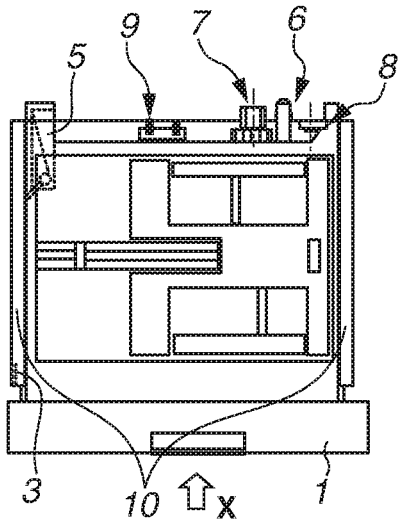
FIGS. 14A, 14B, and 14C are explanatory views each illustrating an operation to attach a sheet feeding cassette.
Figure 14B:
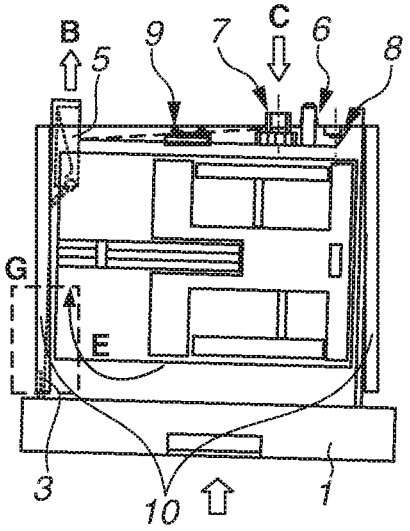
Figure 14C:
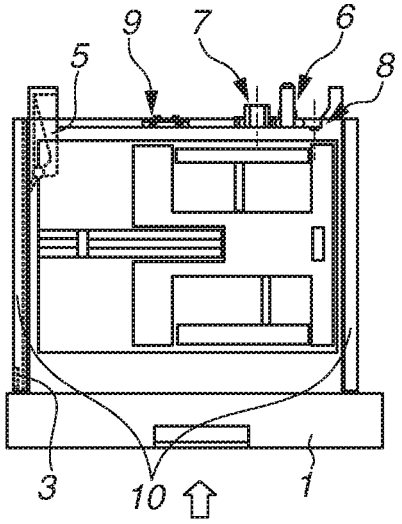

FIGS. 14A, 14B, and 14C are top views illustrating a series of operations from the state in which application of loads to the sheet feeding cassette 1 starts after the unit pull-in mechanism 5 starts the operation for pulling in the sheet feeding cassette 1, to the state in which the attachment of the sheet feeding cassette 1 has been completed. FIG. 14A illustrates the state in which the sheet feeding cassette 1 is pulled out. As illustrated in FIG. 14B, a pulling force B is applied in the attachment direction X from the unit pull-in mechanism 5 disposed on the left side, whereas a load C is applied in the direction opposite to the attachment direction X on the right side. Consequently, a rotation moment E is applied to the sheet feeding cassette 1 in a clockwise direction, and the sheet feeding cassette 1 is rotated. With the rotation of the sheet feeding cassette 1, more loads are applied by the positioning unit 6, by which the sheet feeding cassette 1 is engaged with the main body of the image forming apparatus 100, and the separation unit 8. The reason for this will be described below.

Figure 13A:
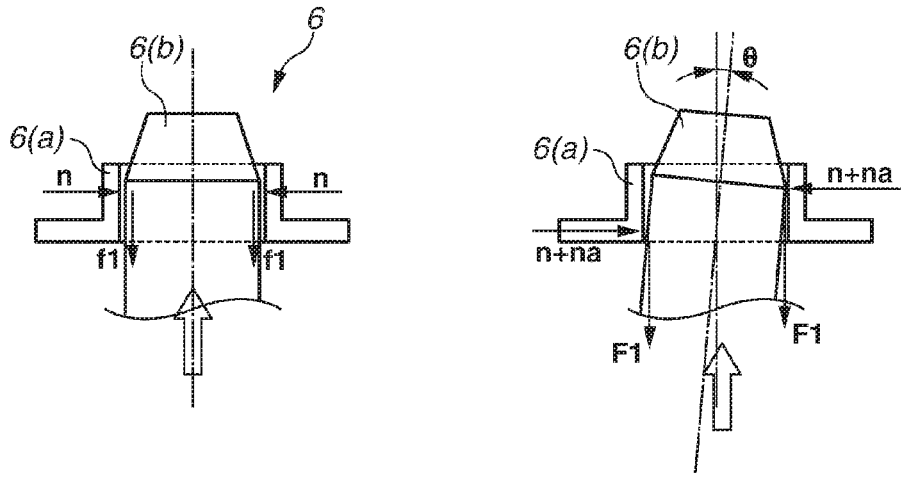
FIGS. 13A and 13B are diagrams each illustrating a change in a resistance load when the orientation of a sheet feeding cassette is changed.
Figure 13B:
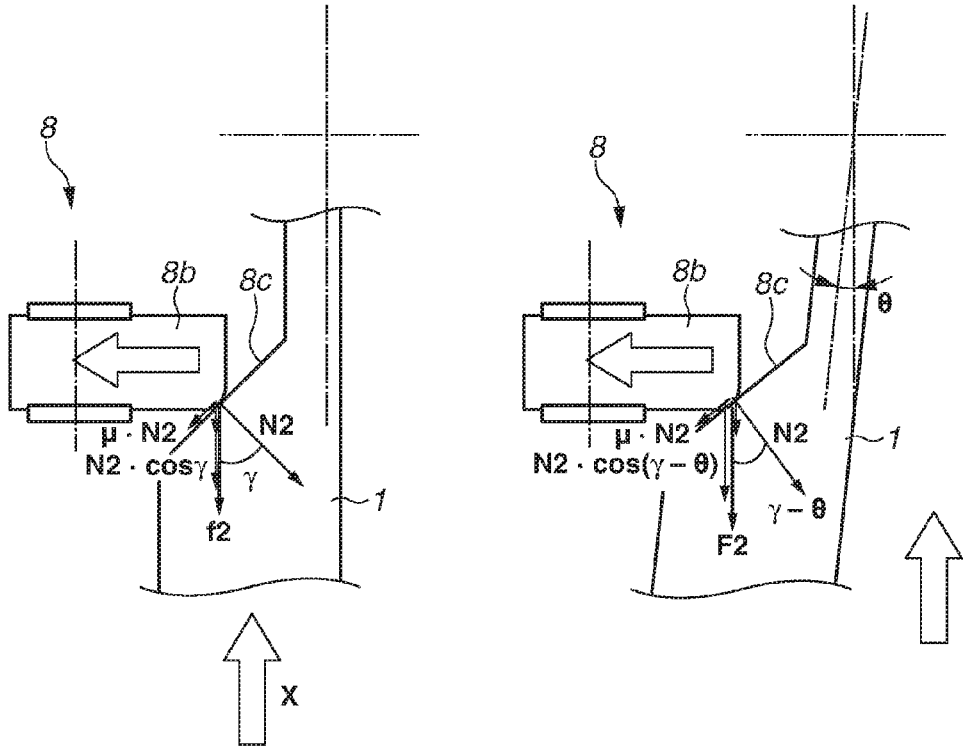

FIGS. 13A and 13B illustrate the loads in the positioning unit 6 and the separation unit 8 at the time when orientation of the sheet feeding cassette 1 is changed. Loads f1 and f2 before the change in orientation are expressed as $f1=\mu \cdot n$ and $f2=N2\cdot(\mu \text{ SIN } \gamma+\text{COS } \gamma)$, where $\mu$ is a dynamic friction coefficient and n and N2 are normal forces of the loads f1 and f2, respectively. Further, loads F1 and F2 after the change in orientation are changed to values expressed by $F1=\mu\cdot(n+na)$ and $F2=N2\cdot(\mu \text{ SIN}(\gamma-\theta)+\text{COS}(\gamma-\theta))$, where na is an increase in the normal force and $\theta$ is a change in the angle of the orientation. From the foregoing expressions it can be understood that the loads increased by the increase na in abutment pressure and the angle change $\theta$.

Accordingly, the unit pull-in mechanism 5 needs to have a sufficiently large pulling force against a load increase accompanied by a change in orientation of the sheet feeding cassette 1, in order to increase the attachment reliability. Accordingly, in the unit pull-in mechanism 5, the pulling force needs to be increased. An increase in pulling force of the unit pull-in mechanism 5 degrades operability because the user operation force increases at the time of attaching and pulling out the sheet feeding cassette 1. Each exemplary embodiment described below solves the problem as follows.

Figure 3A:
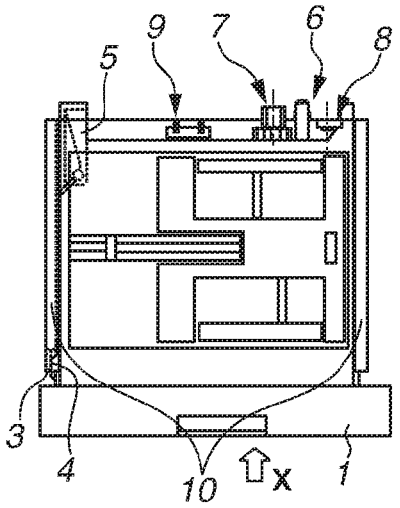
FIGS. 3A, 3B, and 3C are explanatory views each illustrating an operation of a unit moving apparatus according to a first exemplary embodiment.
Figure 3B:
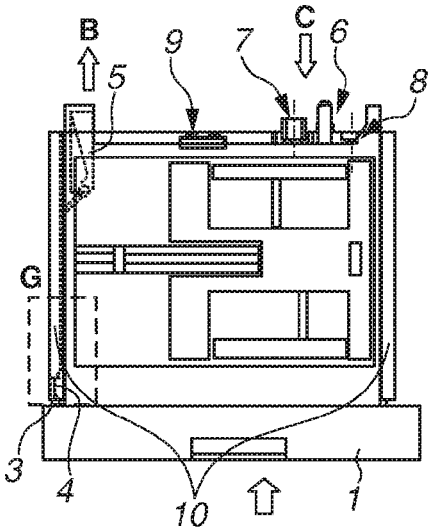
Figure 3C:
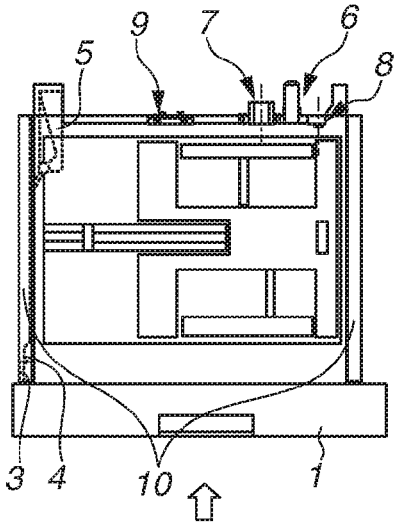
Figure 4A:
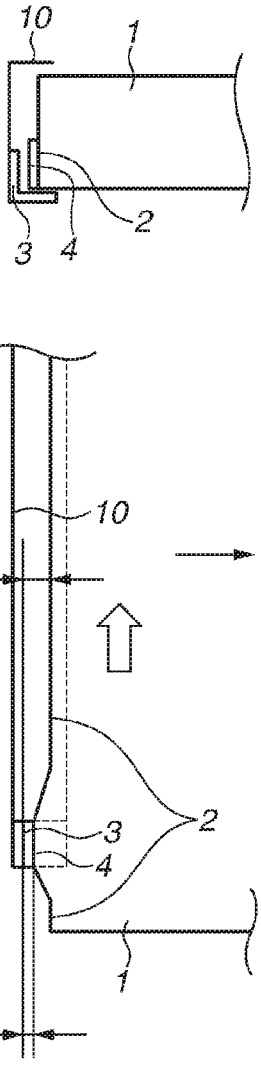
FIGS. 4A, 4B, and 4C are enlarged explanatory views illustrating the unit moving apparatus illustrated in FIGS. 3A, 3B, and 3C, respectively.
Figure 4B:
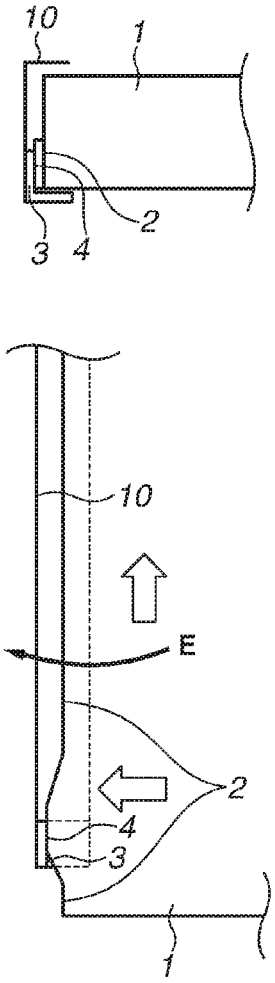
Figure 4C:
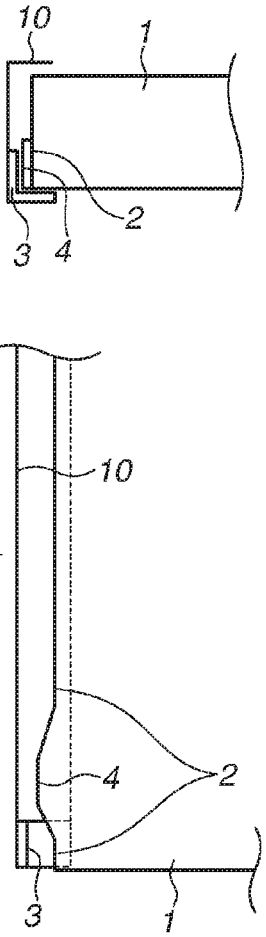

The following describes a unit moving apparatus according to a first exemplary embodiment. In the present exemplary embodiment, the sheet feeding cassette 1 will be described as an example of a unit that is to be moved by the unit moving apparatus. FIGS. 3A, 3B, and 3C illustrate a series of operations from the start of the operation of the unit moving apparatus, according to the first exemplary embodiment, to the attachment of the main body of the image forming apparatus 100 while a load is applied to the sheet feeding cassette 1 as the unit by the main body of the image forming apparatus 100. FIGS. 4A, 4B, and 4C are enlarged views of a section G specified in FIG. 3B, illustrating a cassette guide portion 2 of the sheet feeding cassette 1 and a main-body guide portion 3 of the main body of the image forming apparatus 100.

As illustrated in FIGS. 3A, 3B, and 3C, the positioning unit 6, the driving transmission unit 7, the separation unit 8, the detection unit 9, etc., which apply loads at the time of the attachment of the sheet feeding cassette 1, are disposed between the main body of the image forming apparatus 100 and the sheet feeding cassette 1 as described above. Functions of the respective units are already described above, and thus the description thereof is omitted. Loads may be applied from all of the units or there may be a case where a load is applied from at least one of the units. Even in such a case, the arrangement according to the present exemplary embodiment needs to be applied.

The unit moving apparatus includes a guiding portion, a unit restriction portion 4 provided on the guiding portion, a pull-in mechanism 5 configured to pull in the sheet feeding cassette 1, etc. The guiding portion guides the sheet feeding cassette 1, as the unit, at the attachment into the main body of the image forming apparatus 100. The pull-in mechanism 5 is provided to automatically pull in the sheet feeding cassette 1 from a predetermined position in the main body of the image forming apparatus 100 to an attachment completion position as described above.

The guiding portion includes the cassette guide portion 2 serving as a unit guide portion and the guide rail 10 including a pair of the main-body guide portions 3 provided in the main body of the image forming apparatus 100 to face the cassette guide portion 2. The cassette guide portion 2 is provided on both side end portions of the sheet feeding cassette 1 that are orthogonal to the attachment direction X. The main-body guide portions 3 are partially provided on the guide rail 10 and on the opposite side of the attachment direction X of the sheet feeding cassette 1. The cassette guide portion 2 slidingly abuts against the main-body guide portions 3, so that the sheet feeding cassette 1 can be attached to and pulled out from the main body of the image forming apparatus 100 while the movement of the sheet feeding cassette 1 in the direction orthogonal to the attachment direction X is restricted.

A relatively large clearance is set between the main-body guide portion 3 and the cassette guide portion 2 to avoid unnecessary sliding abutment, which generates resistance at the time of the attachment and detachment of the sheet feeding cassette 1 and hinders user operation, and to achieve processing accuracy with reduced component production costs.

In the present exemplary embodiment, the unit restriction portion 4 is provided to the cassette guide portion 2 at a position, on the cassette guide portion 2, where the cassette guide portion 2 abuts against the main-body guide portion 3 and at a position where application of loads from the units 6, 7, 8, and 9 to the sheet feeding cassette 1 starts following the start of the operation of the unit pull-in mechanism 5. As illustrated in FIGS. 3A, 3B, 3C, 4A, 4B, and 4C, the unit restriction portion 4 has a projecting shape protruding toward the main-body guide portion 3 in the direction in which a part on the opposite side of the attachment direction X, which is on the left side (in the above-mentioned figures) of the cassette guide portion 2, is orthogonal to the attachment direction X.

As a result, as illustrated in FIG. 4A, a clearance D between the unit restriction portion 4 and the main-body guide portion 3 is narrower than a clearance d between the cassette guide portion 2 and the main-body guide portion 3.

As illustrated in FIGS. 3A and 3B, the unit pull-in mechanism 5 starts an operation to pull the sheet feeding cassette 1 in a direction B (indicated by an arrow B in FIG. 3B), and the sheet feeding cassette 1 is pulled into the main body of an image forming apparatus 100. While the sheet feeding cassette 1 is being pulled thereinto, a load C (indicated by an arrow C in FIG. 3*b*) is applied from the units 6, 7, 8, and 9 in the direction opposite to the attachment direction X. At this time, as illustrated in FIGS. 4A and 4B, when the sheet feeding cassette 1 is rotated by the rotation moment E generated by the pulling force and the load C, the unit restriction portion 4 abuts against the main-body guide portion 3. As a result, the amount of movement (rotation amount) of the sheet feeding cassette 1 in the direction orthogonal to the attachment direction X can be reduced compared with a case where no unit restriction portion 4 is provided.

As illustrated in FIG. 4C, in the state in which the sheet feeding cassette 1 is at the attachment completion position in the main body of the image forming apparatus 100, a clearance between the cassette guide portion 2 and the main-body guide portion 3 is about the same as the clearance d.

Figure 5A:
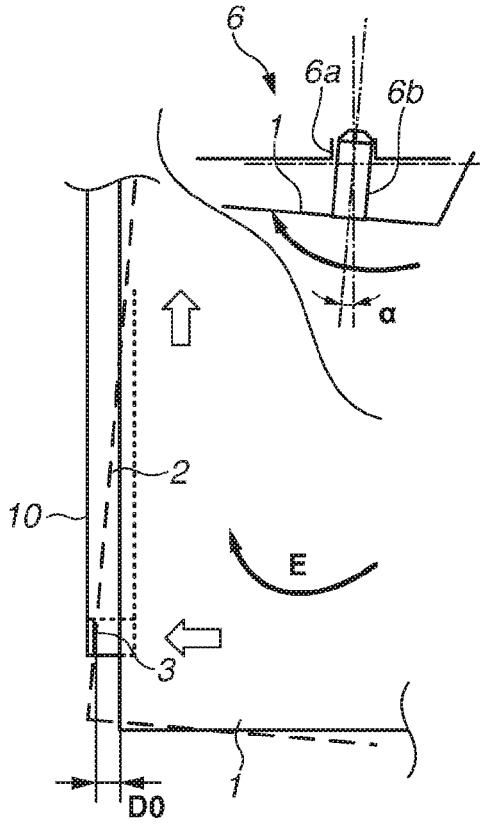
FIGS. 5A and 5B are diagrams each illustrating a relationship between a rotation of a sheet feeding cassette and a positioning unit.
Figure 5B:
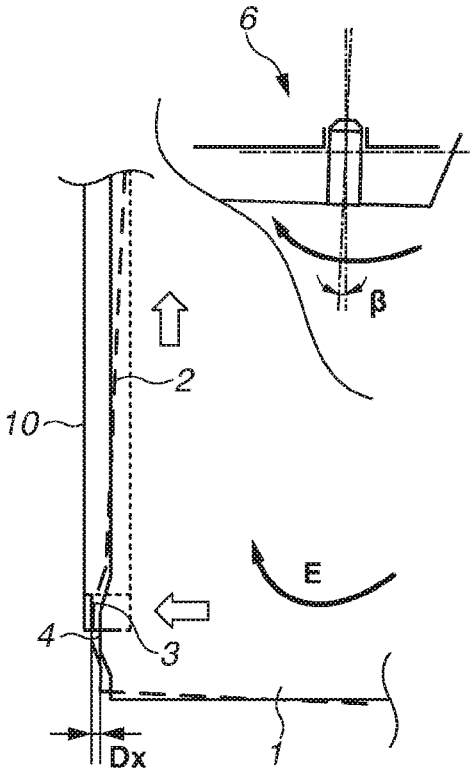

FIG. 5A illustrates the relationship between the guiding portion of the sheet feeding cassette 1 and the positioning unit 6 disposed on the far side of the main body of the image forming apparatus 100 in a configuration in which no unit restriction portion 4 is provided. FIG. 5B illustrates the relationship between the guiding portion and the positioning unit 6 according to the first exemplary embodiment.

In the configuration illustrated in FIG. 5A in which no unit restriction portion 4 is provided, at the position at which application of loads to the sheet feeding cassette 1 starts following the start of the pulling operation of the unit pull-in mechanism 5, the position of the attachment direction X side of the sheet feeding cassette 1 is held by the positioning unit 6. Further, the movement in the direction orthogonal to the attachment direction X is decreased with other units 7, 8, and 9, etc., which generate loads. Meanwhile, the opposite side of the attachment direction X of the sheet feeding cassette 1 can be moved by a clearance DO between the sheet feeding cassette 1 and the main-body guide portion 3, so that the entire sheet feeding cassette 1 is rotated about the positioning unit 6 or about the load application point, by the rotation moment E applied to the sheet feeding cassette 1.

On the contrary, in the case of the unit moving apparatus according to the present exemplary embodiment, a movement amount clearance Dx in the direction orthogonal to the attachment direction X is smaller than the clearance DO specified in FIG. 5A due to the unit restriction portion 4, as illustrated in FIG. 5B. Accordingly, a rotation angle $\mu$ at which the entire sheet feeding cassette 1 rotates with the rotation moment E caused by the load is also smaller than a rotation angle $\alpha$ specified in FIG. 5A. Accordingly, an increase in the load applied by the positioning unit 6, which is caused by the rotation of the unit sheet feeding cassette 1 described above, can be restrained.

A smaller value of the clearance D produces more beneficial effects, but a value of 0 cannot be achieved in terms of processing accuracy or assembly accuracy. Rather, setting the value to 0 can lead to an increase in sliding resistance between the guides, resulting in operational degradation at the time of attachment. However, decreasing the abutment length of the unit restriction portion 4 (length of the sheet feeding cassette 1 in the attachment direction) can realize the smallest clearance that can achieve processing accuracy enhancement and prevent an increase in load resistance.

Figure 6A:
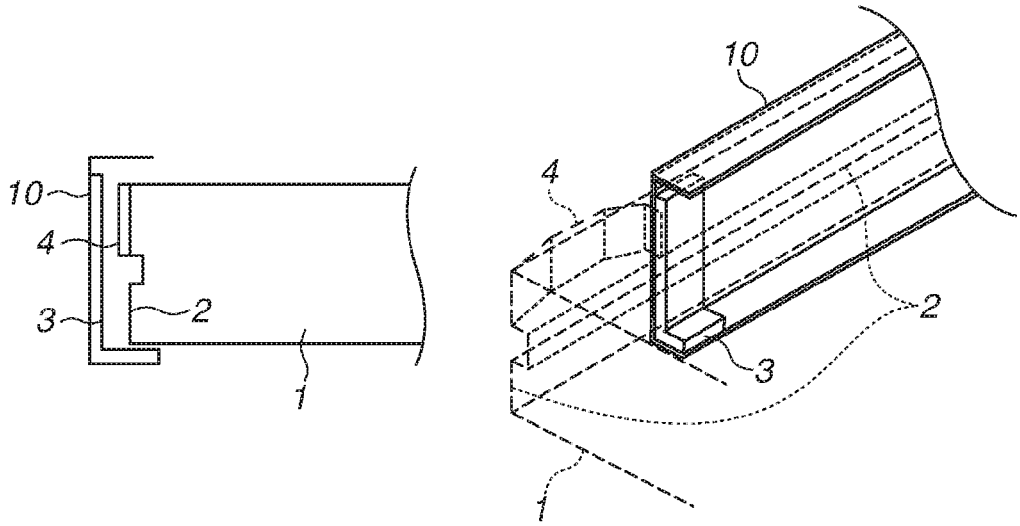
FIGS. 6A and 6B are diagrams each illustrating a modified example of the first exemplary embodiment.

While a portion of the cassette guide portion 2 is in a projecting shape to form the unit restriction portion 4 according to the present exemplary embodiment, a unit restriction portion 4 to abut against the main-body guide portion 3 may be provided separately from the cassette guide portion 2 as illustrated in FIG. 6A. In the present exemplary embodiment, since clockwise rotation (in FIG. 5B) occurs due to the positional relationship of the unit pull-in mechanism 5 and the units generating loads, the unit restriction portion 4 is provided on the left side of the sheet feeding cassette 1. However, in a case where anticlockwise rotation is to be generated due to the positional relationship of the unit pull-in mechanism 5 and the units generating loads, the unit restriction portion 4 needs to be provided on the right side. In a case of the sheet feeding cassette 1 to be shared by various image forming apparatus main bodies, the unit restriction portion 4 may be provided on both sides.

In the present exemplary embodiment, the main-body guide portion 3 is provided not throughout the entire area from the opposite side of the attachment direction X to the attachment direction X side to further reduce the sliding resistance between the sheet feeding cassette 1 and the main-body guide portion 3 as described above. Alternatively, the sliding resistance between the guide rail 10 and the cassette guide portion 2 may be decreased, and the sheet feeding cassette 1 may be guided by the guide rail 10 without the use of the main-body guide portion 3. In this case, when the sheet feeding cassette 1 is rotated by the rotation moment E, the unit restriction portion 4 abuts against the guide rail 10 to restrict the rotation. In other words, the guide rail 10 corresponds to the main-body guide portion 3.

Figure 6B:
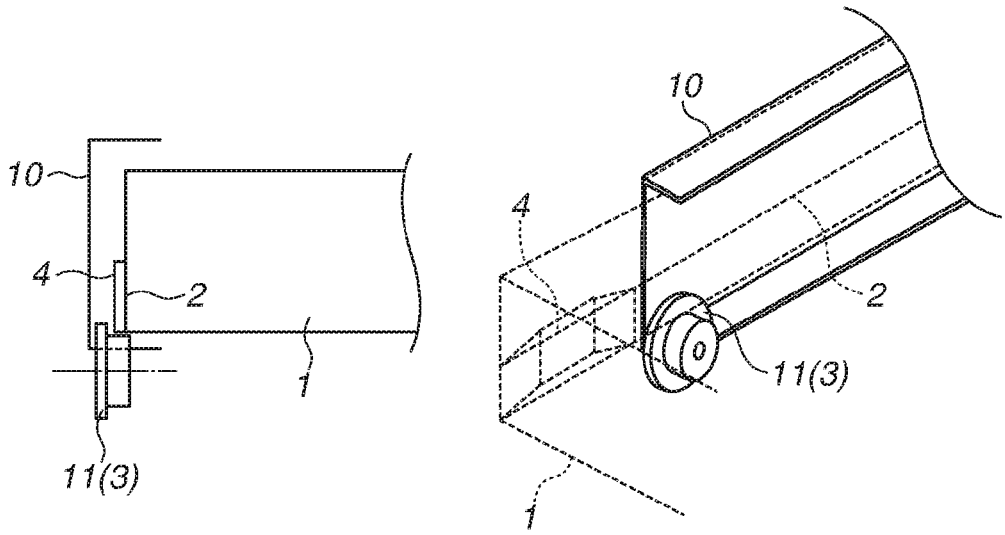

Further, as illustrated in FIG. 6B, the main-body guide portion 3 may be a stepped driven roller 11 to restrict an increase in load due to the sliding resistance at the time of the abutment against the unit restriction portion, so that the resistance of the sheet feeding cassette 1 in the attachment direction X is reduced, which improves reliability of the unit moving apparatus.

The guide rail 10 is made of a folded plate-shaped metal. For the main-body guide portion 3*a*, low-resistance synthetic resin may be used to reduce the sliding resistance generated when the main-body guide portion 3*a* abuts against the cassette guide portion 2 of the sheet feeding cassette 1. Further, the cassette guide portion 2 may be integrally formed with the sheet feeding cassette 1, or a rail shaped portion separately formed with the cassette guide portion 2 may be fixed to the sheet feeding cassette 1. A low-resistance synthetic resin may be also used for the cassette guide portion 2 to reduce the sliding resistance.

Figure 7A:
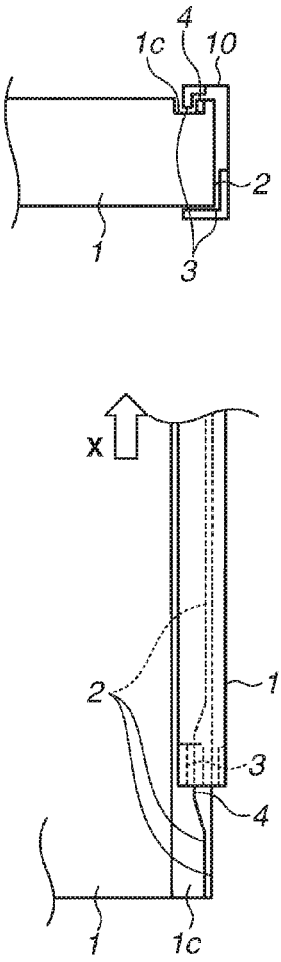
FIGS. 7A, 7B and 7C are explanatory views illustrating an operation of a unit moving apparatus according to a second exemplary embodiment.
Figure 7B:
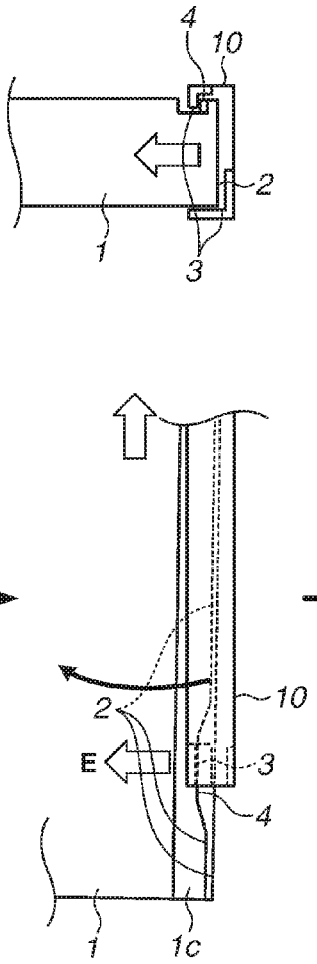
Figure 7C:
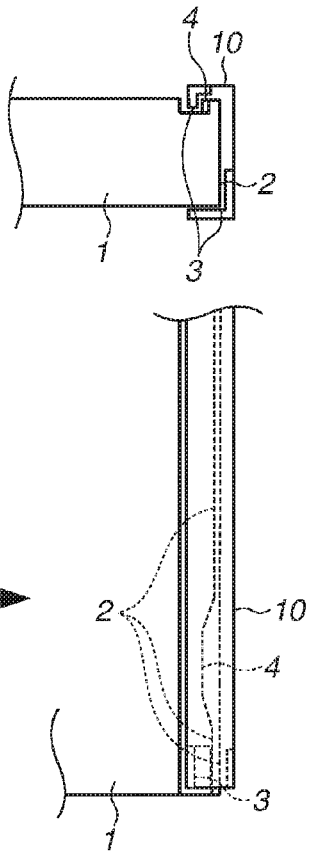

The following describes a unit moving apparatus according to a second exemplary embodiment. FIGS. 7A, 7B, and 7C illustrate a series of operations of the unit moving apparatus according to the second exemplary embodiment. In the following description of the second exemplary embodiment, similar components to those in the first exemplary embodiment are given the same reference numerals, and description thereof is omitted.

The unit moving apparatus according to the present exemplary embodiment includes a guiding portion, a unit restriction portion 4 provided to the guiding portion, a pull-in mechanism 5 configured to pull in the sheet feeding cassette 1, etc. The guiding portion guides a sheet feeding cassette 1 being attached into a main body of an image forming apparatus 100. The guiding portion includes cassette guide portions 2 and a guide rail 10 including main-body guide portions 3 provided in the main body of the image forming apparatus 100 (guide rail 10) to face the cassette guide portions 2. The cassette guide portion 2 is provided on a lower part of a side surface of the sheet feeding cassette 1 that is orthogonal to the attachment direction X. The guiding portion further includes cassette guide portion 2 provided on a side surface of a groove 1*c* formed on an upper surface of the sheet feeding cassette 1 along the attachment direction X of the sheet feeding cassette 1. The guiding portion further includes the main-body guide portion 3 provided in the main body of the image forming apparatus 100 (guide rail 10) to face a guide portion provided on the upper part thereof. The guiding portion includes the cassette guide portions 2 and 2 disposed on the top and the bottom of these and the main-body guide portions 3 and 3.

In the present exemplary embodiment, the cassette guide portions 2 and 2 serving as unit guide portions provided on the right side of the sheet feeding cassette 1 are sandwiched in the right and left direction between the main-body guide portions 3 and 3 which face the cassette guide units 2 and 2 and are provided on the guide rail 10 on the right side. This configuration restricts the rightward and leftward movements of the sheet feeding cassette 1 in the direction orthogonal to the attachment direction X.

Further, as in the first exemplary embodiment, a portion of the cassette guide portion 2 provided on the groove 1*c* formed on the upper surface of the sheet feeding cassette 1 is projected toward the main-body guide portion 3 to form a unit restriction portion 4 in the projecting shape (projecting portion). While the unit restriction portion 4 is formed in the projecting shape (projecting portion) projecting from the sheet feeding cassette 1 toward the main-body guide portion 3 provided on the upper side in the present exemplary embodiment as an example, the unit restriction portion 4 may be in a projecting shape (projecting portion) projecting from the sheet feeding cassette 1 toward the main-body guide portion 3 provided on the lower side, or a projection (projecting portion) may be provided on each of the upper and lower sides.

In the case where the sheet feeding cassette 1 is rotated, by a rotation moment E generated by loads, at a position where application of the loads to the sheet feeding cassette 1 from the respective units 6, 7, 8, and 9 starts following the start of the operation of the pull-in mechanism 5, the unit restriction portion 4 abuts against the main-body guide portions 3. Accordingly, the amount of movement of the sheet feeding cassette 1 in the direction orthogonal to the attachment direction X of the sheet feeding cassette 1 can be made smaller than the amount of movement in other positions, and the rotation of the sheet feeding cassette 1 at that time can be restrained as in the first exemplary embodiment, so that an increase in the loads applied to the sheet feeding cassette 1 can be restrained.

In the present exemplary embodiment, as an example, the unit restriction portion 4 is provided on the surface of the sheet feeding cassette 1 on the right side. However, in a case where anticlockwise rotation is generated due to the positional relationship of the unit pull-in mechanism 5 and the units generating loads, the unit restriction portion 4 needs to be provided on the left side, or the unit restriction portions 4 may be provided on both sides as necessary. While a portion of the cassette guide portion 2 is in the projecting shape to form the unit restriction portion 4 in the present exemplary embodiment, a unit restriction portion 4 to abut against the main-body guide portions 3 may be provided separately from the cassette guide portion 2.

The following describes a unit moving apparatus according to a third exemplary embodiment of the present invention. In the following description of the third exemplary embodiment, similar components to those in the first exemplary embodiment are given the same reference numerals, and description thereof is omitted.

Figure 8A:
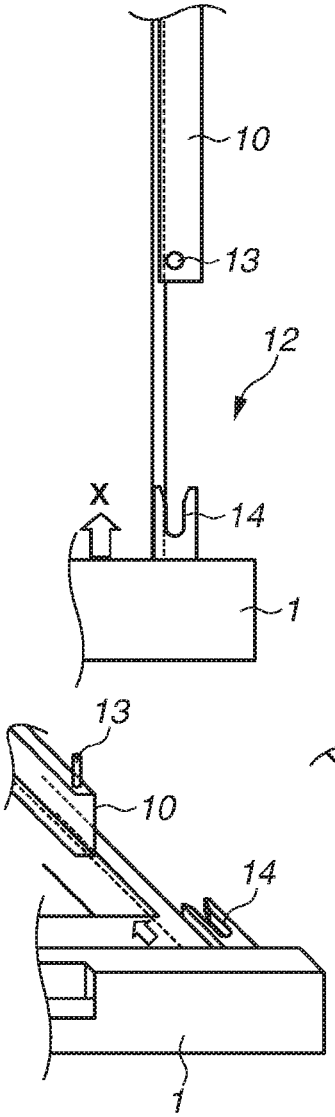
FIGS. 8A, 8B, 8C and 8D are explanatory views each illustrating an operation according to a third exemplary embodiment.
Figure 8B:
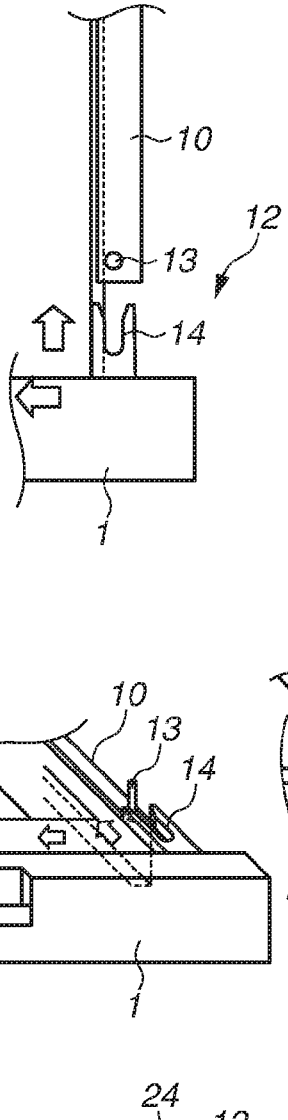
Figure 8C:
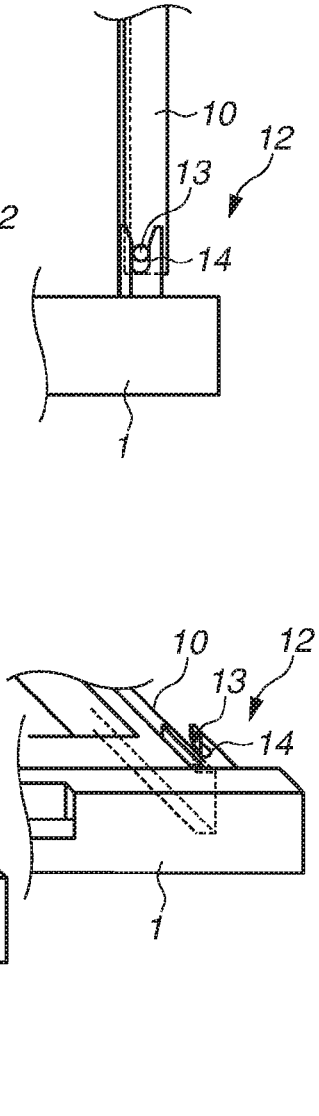

FIGS. 8A, 8B, 8C, and 8D are partial enlarged views of the sheet feeding cassette 1 of the unit moving apparatus according to the present exemplary embodiment. FIGS. 8A, 8B, and 8C illustrate a series of operations from when the unit pull-in mechanism 5 starts an operation, to when the attachment of the sheet feeding cassette 1 to the main body of the image forming apparatus 100 is completed while the load is applied from the main body of the image forming apparatus 100.

In the present exemplary embodiment, the unit moving apparatus includes a second positioning unit 12, a unit restriction portion 24 provided on the second positioning unit 12, a pull-in mechanism 5, etc. The second positioning unit 12 performs the positioning in the attachment of the sheet feeding cassette 1 to the main body of the image forming apparatus 100. The pull-in mechanism 5 pulls the sheet feeding cassette 1 to the attachment completion position.

The second positioning unit 12 is separately provided to the sheet feeding cassette 1 and the main body of the image forming apparatus 100, on the opposite side of the attachment direction X and on the right side with respect to the front face of the image forming apparatus 100. The second positioning unit 12 restricts the position in the direction orthogonal to the attachment direction X.

The second positioning unit 12 includes a positioning groove 14 formed in the sheet feeding cassette 1 and a shaft member 13 as a protruding portion provided on the guide rail 10 of the main body of the image forming apparatus 100. The positioning groove 14 having a U-shaped groove extending in the attachment direction X When the sheet feeding cassette 1 is attached to the main body of the image forming apparatus 100, the shaft member 13 is inserted into the positioning groove 14, which restricts the position of the sheet feeding cassette 1 in the direction orthogonal to the attachment direction X. Alternatively, the positioning groove 14 may be formed in the main body of the image forming apparatus 100 and the shaft member 13 may be provided to the sheet feeding cassette 1.

Figure 8D:
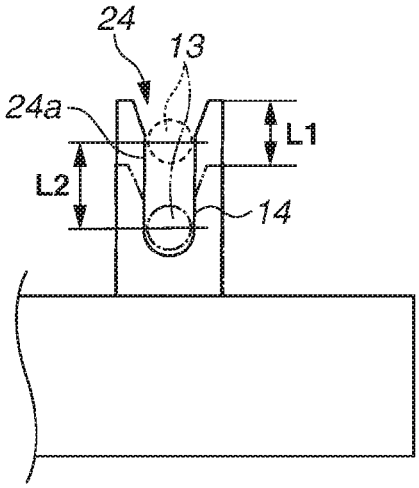

As illustrated in FIG. 8D, the unit restriction portion 24 according to the third exemplary embodiment includes a portion 24*a* and the shaft member 13 as the protruding portion. The portion 24*a* extends the positioning groove 14 by a length L1 in the attachment direction X. The second positioning unit 12 may be in the shape specified by a dashed-dotted line in FIG. 8D if the second positioning unit 12 has only the positioning function, but in order to restrict the rotation of the sheet feeding cassette 1, the positioning groove 14 is extended by the length L1.

A range L2 for the restriction of the shaft member 13 in the positioning groove 14 is set to a range from the position where the sheet feeding cassette 1 starts rotating following the occurrence of the rotation moment E due to the loads applied from the units 6, 7, 8, and 9 (position specified by broken line) to the attachment completion position (position specified by dashed-dotted line). More specifically, the length of the positioning groove 14 is set so as to restrain the rotation of the sheet feeding cassette 1, which is caused by the rotation moment E.

Figure 9:
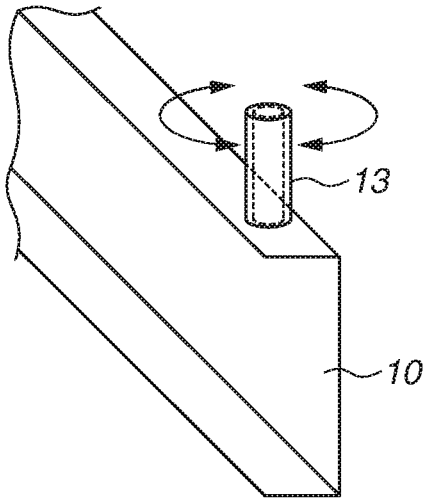
FIG. 9 is a diagram illustrates a modified example of the third exemplary embodiment of the present invention.

At the position where application of the load to the sheet feeding cassette 1 starts following the start of the operation of the unit moving apparatus, the unit restriction portion 24 provided with the positioning groove 14 extending abuts against the shaft member 13 of the main body of the image forming apparatus 100, so that the movement in the direction orthogonal to the attachment direction X is restricted. Accordingly, even if the rotation moment E occurs due to the load, the rotation of the sheet feeding cassette 1 can be restrained, and an increase in load applied to the sheet feeding cassette 1 can be restrained. In a case where the sliding resistance occurring when the shaft member 13 abuts against the unit restriction portion 24*a* is concerned, the shaft member 13 as illustrated in FIG. 9 may be used as the rotation member to further reduce the load.

While the positioning unit 6 including the fitting hole 6*a* and the fitting boss 6*b* is provided on the attachment direction X side of the sheet feeding cassette 1 in the third exemplary embodiment, the positioning unit 6 may be omitted. More specifically, the positioning of the sheet feeding cassette 1 may be realized solely by the second positioning unit 12.

Further, while the unit restriction portion 24 is formed by the U-shaped groove of the second positioning unit 12 extending so that the second positioning unit 12 includes both the positioning function and the rotation restriction function in the third exemplary embodiment, the unit restriction portion 24 does not have to be provided to the second positioning unit 12. More specifically, the unit restriction portion 24 may be formed into a U-shaped groove and include only the function of restricting the rotation of the sheet feeding cassette 1 due to the rotation moment E while not including the positioning function. In such a case, a second positioning unit 12 is provided at another position.

Further, while the unit to be moved by the unit moving apparatus is, as an example, the sheet feeding cassette 1 according to the above-described exemplary embodiments, the unit to which the unit moving apparatus is applicable is not limited to the sheet feeding cassette. For example, a double-sided path DP in FIG. 1 for re-sending a sheet with an image formed on one surface to the image forming unit to form images on both surfaces of the sheet may be configured as a unit, and the unit moving apparatus may be configured as a unit. To perform jam handling process on the double-sided path DP, a unit DU is configured to allow the double-sided path DP to be pulled toward the front face. In such a case, a configuration considered to apply a load to the unit is the positioning unit, the driving transmission unit, etc. The unit DU is attached to the main body of the image forming apparatus 100 by the unit moving apparatus according to any of the first to third exemplary embodiments.

According to the foregoing exemplary embodiments, a unit restriction portion is provided so that a unit moving apparatus having high attachment reliability without degrading the user operability can be provided regardless of the disposition of a unit that applies, to the unit, resistance loads occurring in the pull-in unit and the main body side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-017857, filed Jan. 30, 2015, which is hereby incorporated by reference herein in its entirety.

What is claimed is:

1. A unit moving apparatus comprising:

a unit provided to a main body in such a manner so as to be attached to and pulled out from the main body;

a main-body guide portion provided to the main body and configured to guide the unit while restricting rotation of the unit at a time of attaching and pulling out the unit;

a pull-in unit configured to apply a pulling force to the unit to pull the unit into the main body; and a unit restriction portion configured to restrict rotation of the unit in such a manner that the units rotates within an angle smaller than an angle to which the main-body guide portion restricts the unit's rotation when a rotation moment is generated by the pulling force of the pull-in unit applied to the unit and a load applied to the unit in a direction opposite to an attachment direction.

2. The unit moving apparatus according to claim 1, wherein the unit includes a unit guide portion configured to be guided by the main-body guide portion, and the unit restriction portion is formed in a projecting shape protruding from the unit guide portion toward the main-body guide portion.

3. The unit moving apparatus according to claim 2, wherein the unit guide portion is guided by the main-body guide portion, and attaches the unit to and is pulled out the unit from the main body.

4. The unit moving apparatus according to claim 2, wherein the main-body guide portion is disposed on an opposite side of the attachment direction of the unit.

5. The unit moving apparatus according to claim 1, wherein the unit includes a groove formed along the attachment direction of the unit, the groove includes a unit guide portion configured to be guided by the main-body guide portion, and the unit restriction portion is formed in a projecting shape protruding from the unit guide unit toward the main-body guide portion.

6. The unit moving apparatus according to claim 1, wherein the main-body guide portion includes a stepped driven roller.

7. The unit moving apparatus according to claim 1, wherein the unit restriction portion includes a groove formed in either one of the unit and the main body and a protruding portion which is provided to the other one of the unit and the main body and is inserted into the groove.

8. The unit moving apparatus according to claim 7, wherein the groove and the protruding portion further configured to position the unit.

9. The unit moving apparatus according to claim 1, further comprising a positioning unit, configured to position the unit, including a hole and a boss to be fitted into the hole, wherein the load is a sliding resistance occurring when the boss is fitted into the hole.

10. The unit moving apparatus according to claim 1, wherein the unit is a sheet feeding cassette which stores a sheet and is provided so as to be attached to and pulled out from the main body.

11. A unit moving apparatus comprising:

a unit provided to a main body in such a manner so as to be attached to and pulled out from the main body;

a main-body guide portion configured to guide a unit guide portion provided to the unit at the time of attaching and pulling out the unit;

a pull-in unit configured to pull the unit into the main body; and a unit restriction portion is provided on the unit guide portion and on an opposite side of an attachment direction of the unit in such a manner that a clearance between the unit restriction portion and the main-body guide portion at a time when the unit restriction portion faces the main-body guide portion is smaller than a clearance between the unit guide portion and the main-body guide portion.

12. The unit moving apparatus according to claim 11, wherein the main-body guide portion is disposed on the opposite side of the attachment direction of the unit.

13. The unit moving apparatus according to claim 11, wherein the unit restriction portion is formed in a projecting shape protruding from the unit guide unit toward the main-body guide portion.

14. The unit moving apparatus according to claim 11, wherein, in a case where the unit is at a first position where a pulling force of the pull-in unit is not applied, the unit restriction portion does not face the main-body guide portion, and, in a case where the unit is in a second position where a pulling force of the pull-in unit is applied, the unit restriction portion faces the main-body guide portion.

15. The unit moving apparatus according to claim 11, wherein the unit is a sheet feeding cassette which stores a sheet and is provided so as to be attached to and pulled out from the main body.

16. An image forming apparatus comprising:

a main body;

a unit, provided to the main body so as to be attached to and pulled out from the main body, in which a sheet is stored;

a main-body guide portion, provided to the main body, configured to guide the unit while restricting rotation of the unit at a time of attaching and pulling out the unit;

a pull-in unit configured to apply a pulling force to the unit to pull the unit into the main body; and a unit restriction portion configured to restrict rotation of the unit in such a manner that the units rotates within an angle smaller than an angle to which the main-body guide portion restricts the unit's rotation when a rotation moment is generated by the pulling force of the pull-in unit applied to the unit and a load applied to the unit in a direction opposite to an attachment direction.

* * * * *